US011330374B1

(12) United States Patent
DiLorenzo et al.

(10) Patent No.: US 11,330,374 B1
(45) Date of Patent: May 10, 2022

(54) HEAD-GEAR MOUNTED BONE-CONDUCTING MICROPHONE

(71) Applicant: JLI Electronics Inc., Harleysville, PA (US)

(72) Inventors: Jody DiLorenzo, Hope, ME (US); Peter L. Madaffari, Camden, ME (US)

(73) Assignee: JLI Electronics, Inc., Harleysville, PA (US)

( * ) Notice: Subject to any disclaimer, the term of this patent is extended or adjusted under 35 U.S.C. 154(b) by 0 days.

(21) Appl. No.: 17/506,309

(22) Filed: Oct. 20, 2021

Related U.S. Application Data

(60) Provisional application No. 63/094,366, filed on Oct. 21, 2020.

(51) Int. Cl.
*H04R 17/02* (2006.01)
*A42B 3/30* (2006.01)

(52) U.S. Cl.
CPC ..... *H04R 17/02* (2013.01); *A42B 3/30* (2013.01); *H04R 2410/07* (2013.01)

(58) Field of Classification Search
CPC ..... H04R 17/02; H04R 2410/07; A42B 3/30
See application file for complete search history.

(56) References Cited

U.S. PATENT DOCUMENTS 3,787,641 A * 1/1974 Santori ..... A42B 3/30 381/151
5,404,577 A 4/1995 Zuckerman et al.
7,110,743 B2 9/2006 Depew et al.
8,194,875 B2 * 6/2012 Miranda ..... A42B 3/30 381/74
9,094,749 B2 7/2015 Xie et al.
9,978,397 B2 5/2018 Kar et al.
2011/0319021 A1 * 12/2011 Proulx ..... H04R 17/02 381/151
2019/0282197 A1 * 9/2019 Matsumoto ..... A61B 7/04

FOREIGN PATENT DOCUMENTS

KR 200317070 6/2003
WO WO2000059049 10/2000
WO WO20100133812 11/2010

OTHER PUBLICATIONS

ATEX Helmet. www.titancomsys.com/ex-helmet-equipment/. 2021.
PRYME. www.hq98.com/pryme-spm-1700-in-helmet-skull-mic-with-bone-condution/. 2015.

* cited by examiner

*Primary Examiner* — Brian Ensey
(74) *Attorney, Agent, or Firm* — Joseph E. Maenner; Petock & Petock LLC

(57) ABSTRACT

A head-gear mounted bone-conducting microphone includes a housing attachable to a helmet and a transducer housed in a flexible shroud. The shroud is attached to the housing. A resilient material is disposed within the shroud. A void is provided between the resilient material and the housing to prevent the transducer from transmitting vibrations directly from the housing to the transducer. This configuration allows the microphone to effectively mechanically isolate the minuscule vibrations associated with speech from the enormous vibrations associated with most loud environments (machinery, equipment, transportation, aircraft, tanks, construction, sporting events, etc.).

20 Claims, 2 Drawing Sheets

HEAD-GEAR MOUNTED BONE-CONDUCTING MICROPHONE

BACKGROUND OF THE INVENTION

Field of the Invention

The present invention relates to a bone-conducting microphone that is mounted in or on a headgear, such as a helmet, a headset, or glasses, and is stimulated by vibrations generated in the wearer's skull as the wearer speaks.

Description of the Related Art

Helmet mounted microphones that operate on the vibrations generated by the wearer's skull as the wearer speaks are known. These microphones, however, are generally used at or around a single altitude, such as for first responders (e.g., fire, rescue, etc.), and are not intended to be used at varying altitudes where air pressure fluctuations can adversely affect the quality of sound generated from the microphones. Such air pressure fluctuations can be present in military operations, where the helmet/wearer can be between ground level and high altitudes in a plane or helicopter.

It would be beneficial to provide a bone-conducting microphone that provides good sound quality at varying altitudes. It would also be beneficial to provide a bone-conducting microphone that mechanically isolates the minuscule vibrations associated with speech from the enormous vibrations associated with most loud environments (machinery, equipment, transportation, aircraft, tanks, construction, etc.).

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, the present invention is a helmet mounted bone microphone mounted in a helmet for engagement with the frontal or parietal bones of the user's skull, such that vibration in the skull, generated by sounds emitted by the user, are picked up by a transducer in the bone microphone and converted to electronic signals for transmission to a transmitter.

In another embodiment, the present invention is a microphone that includes a housing attachable to a helmet and a transducer housed in a flexible shroud. The shroud is attached to the housing. A resilient material is disposed within the shroud. A void is provided between the resilient material and the housing to prevent the housing from transmitting vibrations directly from the housing to the transducer. Vibrations generated by speech are transmitted to the transducer while other vibrations are mechanically isolated from the transducer.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION

Figure 1:
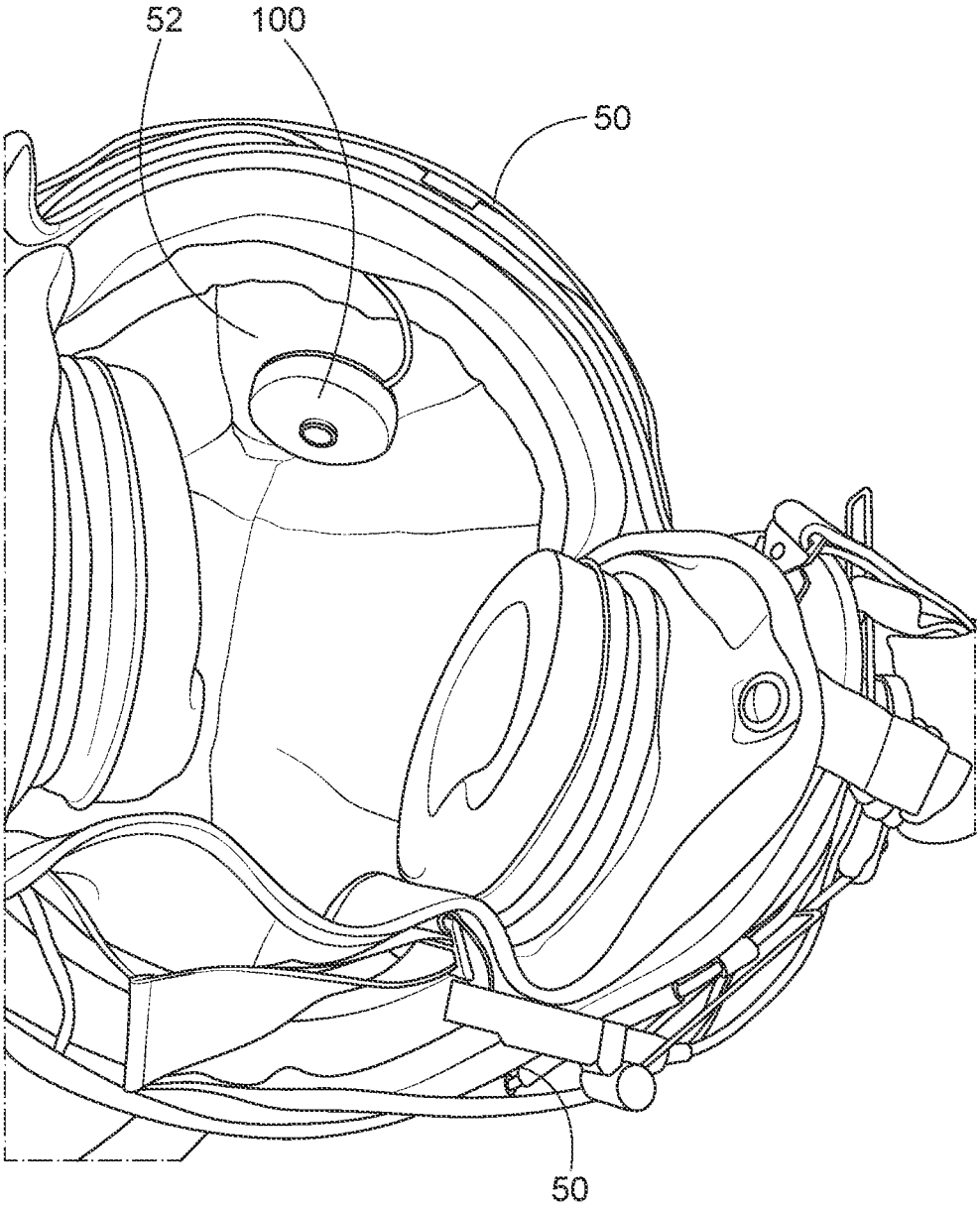
FIG. 1 is a perspective view of a helmet mounted microphone according to an exemplary embodiment of the present invention, mounted inside a helmet.

In the drawings, like numerals indicate like elements throughout. Certain terminology is used herein for convenience only and is not to be taken as a limitation on the present invention. The terminology includes the words specifically mentioned, derivatives thereof and words of similar import. The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

The word "about" is used herein to include a value of +/−10 percent of the numerical value modified by the word "about" and the word "generally" is used herein to mean "without regard to particulars or exceptions."

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Unless explicitly stated otherwise, each numerical value and range should be interpreted as being approximate as if the word "about" or "approximately" preceded the value of the value or range.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the present invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

The present invention provides a bone activated microphone 100 (bone mic 100) that is activated by vibrations through a user's skull when the user speaks. Bone Mic 100 can be installed on any head-mounted gear (e.g., in a helmet, on a headset or glasses, etc.) such as for a soldier, a first responder, or other person who wears a helmet in a loud ambient noise environment and who wants or needs a hands-free microphone.

A sectional view of bone mic 100 is shown in FIG. 1. Bone mic 100 can be installed in a helmet 50, such as for a soldier, a first responder, or other person who wears a helmet in a loud ambient noise environment and who may experience significant altitude changes while using bone mic 100.

Figure 2:
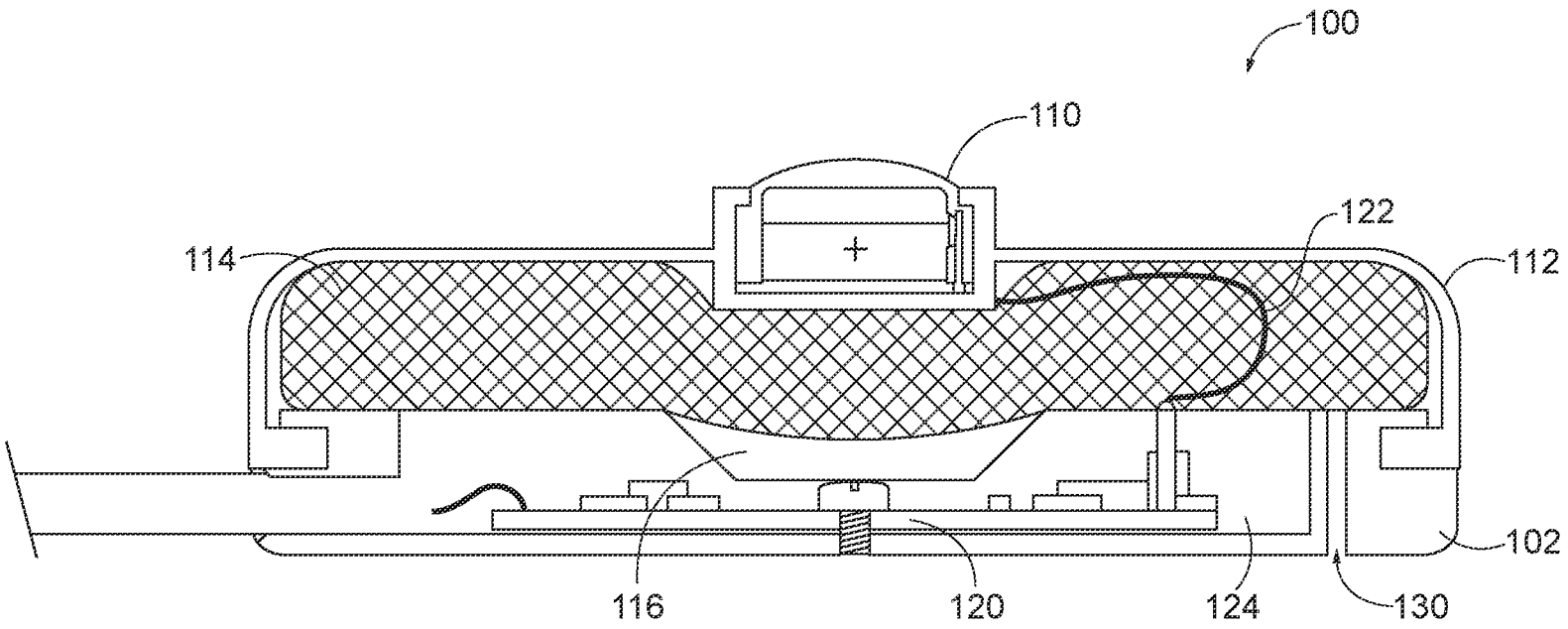
FIG. 2 is a side elevational view, in section, of the helmet mounted microphone of FIG. 1.

Referring to FIG. 2, bone mic 100 includes a housing 102 that is attached to helmet 50 so that a transducer 110 can rest on the user's skull, preferably against the frontal or parietal bones, although those skilled in the art will recognize that transducer 110 can rest against other parts of the skull. Transducer 110 is sensitive enough to convert the small vibrations on the surface of a head associated with speech to electrical signal to be amplified. Housing 102 can be constructed from a metal, including but not limited to ferromagnetic steel, which is critical for dampening noise vibrations from the helmet side, which would interfere with the operation of bone mic 100. Also, the optional ferromagnetic steel acts as a shield against magnetic fields, which can adversely affect operation of bone mic 100. In an exemplary embodiment, housing 102 is anodized after machining or thread tapping to prevent oxidation of housing 102.

Transducer 110 is housed in a flexible shroud 112 that contains a resilient material 114, such as a foam, to support transducer 110 and to allow for movement of transducer 110 with respect to the user's skull. Shroud 112 has a thin, flexible wall that is critical for protecting components inside bone mic 100 while keeping alignment without transmitting vibrations. Resilient material 114 can be open cell foam.

An empty void, or gap 116, is provided between the resilient material 114 and the housing 102 to prevent the transducer 110 from being crushed against the housing 102 and transmitting vibrations directly from the housing 102 to the transducer 110. Vibrations generated by speech are transmitted to the transducer 110 while other, significant ambient vibrations are mechanically isolated from the transducer 110. Such vibrations can be generated by machinery, equipment, transportation, aircraft, tanks, construction, among other things. Gap 116 is critical to the operation of bone mic 100 to prevent unwanted vibrations to be transmitted to transducer 110, which in turn would convert those vibrations into noise that would interfere with the operation of bone mic 100.

In an exemplary embodiment, the transducer 110 is electronically attached to a printed circuit (PC) board 120 via a flexible wire 122. Flexible wire 122 is used to eliminate or minimize vibration conduction along the length of wire 122. PC Board 120 is covered with an encapsulating material 124 to protect against corrosion and electrical shorts. PC board 120 is grounded to housing 102 to isolate any electrical noise. PC board 120 can include or be hard wired to a radio transmitter (not shown) and is used to amplify a signal generated by transducer 110 to transmit electronic signals corresponding to sound from the user, to a receiver (not shown).

A vent hole 130 is provided through the housing 102 and is in fluid communication with the resilient material 114 to allow for consistent pressure in all atmospheres and altitudes. Vent hole 130 keeps a consistent pressure inside bone mic 100 in all atmospheres/altitudes, thereby allowing bone mic 100 to be operated on a consistent basis.

The bone mic 100 can be fit into existing helmets, as shown in FIG. 1, which require a cutout to allow for the attachment of bone mic 100 to the padding 52 on the inside of the helmet 50. Wiring then has to be run from the bone mic 100 to existing communication ports in the helmet. Alternatively, bone mic 100 can be integrated into the helmet 50 during construction of the helmet 50.

In an exemplary embodiment of the operation of bone mic 100, with bone mic 100 inside helmet 50 as shown in FIG. 1, a user puts helmet 50 on his/her head, with transducer 110 of bone mic 100 in contact with the frontal or parietal bones of the user's skull. When the user speaks, vibrations from the user's mouth are transmitted to the skull, such that transducer 110 picks up the vibrations and transmits the vibrations, in the form of electrical signals, along wire 122, to PC board 120 for processing and subsequent wireless transmitting via a transmitter (not shown). With bone mic 100 mounted in helmet 50, ambient noises are reduced or eliminated.

It will be further understood that various changes in the details, materials, and arrangements of the parts which have been described and illustrated in order to explain the nature of this invention may be made by those skilled in the art without departing from the scope of the invention as expressed in the following claims.

We claim:

1. A head-gear mounted bone-conducting microphone comprising:

a housing attachable to a helmet;

a transducer sensitive enough to convert small vibrations on a surface of a head associated with speech to electrical signal to be amplified, the transducer being housed in a flexible shroud, the shroud being attached to the housing;

a resilient material disposed within the shroud; and a void between the resilient material and the housing, the void preventing the housing from transmitting ambient noise vibrations directly from the housing to the transducer, wherein vibrations generated by speech are transmitted to the transducer while the ambient noise vibrations are mechanically isolated from the transducer.

2. The head-gear mounted bone-conducting microphone according to claim 1, further comprising a circuit board grounded to the housing, the circuit board configured to transmit an electronic signal to a receiver.

3. The head-gear mounted bone-conducting microphone according to claim 2, wherein the circuit board is covered with an encapsulating material.

4. The head-gear mounted bone-conducting microphone according to claim 1, further comprising a vent hole provided through the housing and in fluid communication with the resilient material to allow for consistent pressure in all atmospheres and altitudes.

5. The head-gear mounted bone-conducting microphone according to claim 1, wherein the housing is constructed from a dense metal.

6. The head-gear mounted bone-conducting microphone according to claim 4, wherein the metal comprises a ferromagnetic steel.

7. The head-gear mounted bone-conducting microphone according to claim 1, wherein the resilient material comprises a foam.

8. The head-gear mounted bone-conducting microphone according to claim 1, wherein the resilient material supports the transducer and allows for movement of the transducer with respect to a user's skull.

9. The head-gear mounted bone-conducting microphone according to claim 1, wherein the resilient material comprises an open cell foam.

10. A head-gear mounted bone-conducting microphone comprising:

a housing attachable to a head-gear;

a transducer housed in a flexible shroud, the shroud being attached to the housing;

a resilient material disposed within the shroud; and a vent hole provided through the housing and in fluid communication with the resilient material to allow for consistent pressure in all atmospheres and altitudes, wherein vibrations generated by speech are transmitted to the transducer while other vibrations are mechanically isolated from the transducer.

11. The head-gear mounted bone-conducting microphone according to claim 10, wherein an empty void is provided between the resilient material and the housing.

12. The head-gear mounted bone-conducting microphone according to claim 11, wherein the void prevents the transducer from being crushed against the housing.

13. The head-gear mounted bone-conducting microphone according to claim 11, wherein the void prevents transmitting vibrations directly from the housing to the transducer.

14. The head-gear mounted bone-conducting microphone according to claim 11, wherein the void prevents unwanted vibrations to be transmitted to the transducer.

15. The head-gear mounted bone-conducting microphone according to claim 10, wherein the transducer is electronically attached to a PC board via a flexible wire.

16. The head-gear mounted bone-conducting microphone according to claim 15, wherein the flexible wire eliminates or minimizes vibration conduction along a length of the wire.

17. The head-gear mounted bone-conducting microphone according to claim 15, wherein the PC board 120 is covered with an encapsulating material to protect against corrosion and electrical shorts.

18. The head-gear mounted bone-conducting microphone according to claim 15, wherein the PC board is grounded to the housing to isolate any electrical noise.

19. A head-gear mounted bone-conducting microphone comprising:

a housing attachable to a head-gear;

a transducer housed in a flexible shroud, the shroud being attached to the housing;

a resilient material disposed within the shroud;

a void between the resilient material and the housing, the void preventing the housing from transmitting vibrations directly from the housing to the transducer; and a vent hole provided through the housing and in fluid communication with the resilient material to allow for consistent pressure in all atmospheres and altitudes, wherein vibrations generated by speech are transmitted to the transducer while other vibrations are mechanically isolated from the transducer.

20. The head-gear mounted bone-conducting microphone according to claim 19, wherein the void prevents transmitting vibrations directly from the housing to the transducer.

* * * * *